US006052065A

United States Patent [19]

Glover

[11] Patent Number: 6,052,065

[45] Date of Patent: Apr. 18, 2000

[54] VIN READING AND TRANSMITTING SYSTEM

[76] Inventor: Deborah L Glover, 3226 Valley View St., Powder Springs, Ga. 30073-1871

[21] Appl. No.: 08/910,517

[22] Filed: Aug. 7, 1997

[51] Int. Cl.[7] ..... G08B 13/14

[52] U.S. Cl. ..... 340/825.54; 340/825.69; 340/825.71; 340/825.72; 340/572.1; 340/572.8; 342/42; 342/44; 342/51; 701/300

[58] Field of Search ..... 340/825.54, 825.69, 340/825.71, 825.72, 505, 572, 572.1, 572.8; 342/51, 44, 42; 367/2, 6; 180/313; 701/300; 1/1

[56] References Cited

U.S. PATENT DOCUMENTS 5,008,661 4/1991 Raj ..... 340/825.54
5,450,492 9/1995 Hook et al. ..... 340/572.4 X
5,537,105 7/1996 Marsh et al. ..... 340/825.54
5,726,630 3/1998 Marsh et al. ..... 340/572.4
5,850,187 12/1998 Carrender et al. ..... 340/825.54

*Primary Examiner*—Michael Horabik
*Assistant Examiner*—Yves Dalencourt

[57] ABSTRACT

A new VIN Reading and Transmitting System for providing a device for automatically detecting a vehicle identification number and transmitting the number to a dispatch station for immediate identification of the vehicle and owner. The inventive device includes a vehicle unit containing the vehicle identification number, a portable unit which enables the vehicle unit to transmit the number which is detected by the portable unit, a digital repeater which receives a signal from the portable unit for transmitting to a receiver at the dispatch office where the number can be utilized to disclose the vehicle and the owner which can be transmitted to the police officer immediately.

3 Claims, 2 Drawing Sheets

VIN READING AND TRANSMITTING SYSTEM

BACKGROUND OF THE INVENTION

1. Field of the Invention

The present invention relates to VIN Reading Devices and more particularly pertains to a new VIN Reading and Transmitting System for providing a device for automatically detecting a vehicle identification number and transmitting the number to a dispatch station for immediate identification of the vehicle and owner.

2. Description of the Prior Art

The use of VIN Reading Devices is known in the prior art. More specifically, VIN Reading Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art VIN Reading Devices include U.S. Pat. 4,837,568; U.S. Pat. No. 4,742,573; U.S. Pat. No. 5,204,670; U.S. Design Patent 355,903; U.S. Pat. No. 3,955,560 and U.S. Pat. No. 4,137,520.

While these devices fulfill their respective, particular objectives and requirements, the aforementioned patents do not disclose a new VIN Reading and Transmitting System. The inventive device includes a vehicle unit containing the vehicle identification number, a portable unit which enables the vehicle unit to transmit the number which is detected by the portable unit, a digital repeater which receives a signal from the portable unit for transmitting to a receiver at the dispatch office where the number can be utilized to disclose the vehicle and the owner which can be transmitted to the police officer immediately.

In these respects, the VIN Reading and Transmitting System according to the present invention substantially departs from the conventional concepts and designs of the prior art, and in so doing provides an apparatus primarily developed for the purpose of providing a device for automatically detecting a vehicle identification number and transmitting the number to a dispatch station for immediate identification of the vehicle and owner.

SUMMARY OF THE INVENTION

In view of the foregoing disadvantages inherent in the known types of VIN Reading Devices now present in the prior art, the present invention provides a new VIN Reading and Transmitting System construction wherein the same can be utilized for providing a device for automatically detecting a vehicle identification number and transmitting the number to a dispatch station for immediate identification of the vehicle and owner.

The general purpose of the present invention, which will be described subsequently in greater detail, is to provide a new VIN Reading and Transmitting System apparatus and method which has many of the advantages of the VIN Reading Devices mentioned heretofore and many novel features that result in a new VIN Reading and Transmitting System which is not anticipated, rendered obvious, suggested, or even implied by any of the prior art VIN Reading Devices, either alone or in any combination thereof To attain this, the present invention generally comprises a vehicle unit containing the vehicle identification number, a portable unit which enables the vehicle unit to transmit the number which is detected by the portable unit, a digital repeater which receives a signal from the portable unit for transmitting to a receiver at the dispatch office where the number can be utilized to disclose the vehicle and the owner which can be transmitted to the police officer immediately.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new VIN Reading and Transmitting System apparatus and method which has many of the advantages of the VIN Reading Devices mentioned heretofore and many novel features that result in a new VIN Reading and Transmitting System which is not anticipated, rendered obvious, suggested, or even implied by any of the prior art VIN Reading Devices, either alone or in any combination thereof.

It is another object of the present invention to provide a new VIN Reading and Transmitting System which may be easily and efficiently manufactured and marketed.

It is a further object of the present invention to provide a new VIN Reading and Transmitting System which is of a durable and reliable construction.

An even further object of the present invention is to provide a new VIN Reading and Transmitting System which is susceptible of a low cost of manufacture with regard to both materials and labor, and which accordingly is then susceptible of low prices of sale to the consuming public, thereby making such VIN Reading and Transmitting System economically available to the buying public.

Still yet another object of the present invention is to provide a new VIN Reading and Transmitting System which provides in the apparatuses and methods of the prior art some of the advantages thereof, while simultaneously overcoming some of the disadvantages normally associated therewith.

Still another object of the present invention is to provide a new VIN Reading and Transmitting System for providing a device for automatically detecting a vehicle identification number and transmitting the number to a dispatch station for immediate identification of the vehicle and owner.

Yet another object of the present invention is to provide a new VIN Reading and Transmitting System which includes a vehicle unit containing the vehicle identification number, a portable unit which enables the vehicle unit to transmit the number which is detected by the portable unit, a digital repeater which receives a signal from the portable unit for transmitting to a receiver at the dispatch office where the number can be utilized to disclose the vehicle and the owner which can be transmitted to the police officer immediately.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof Such description makes reference to the annexed drawings wherein.

DESCRIPTION OF THE PREFERRED EMBODIMENT

Figure 1:
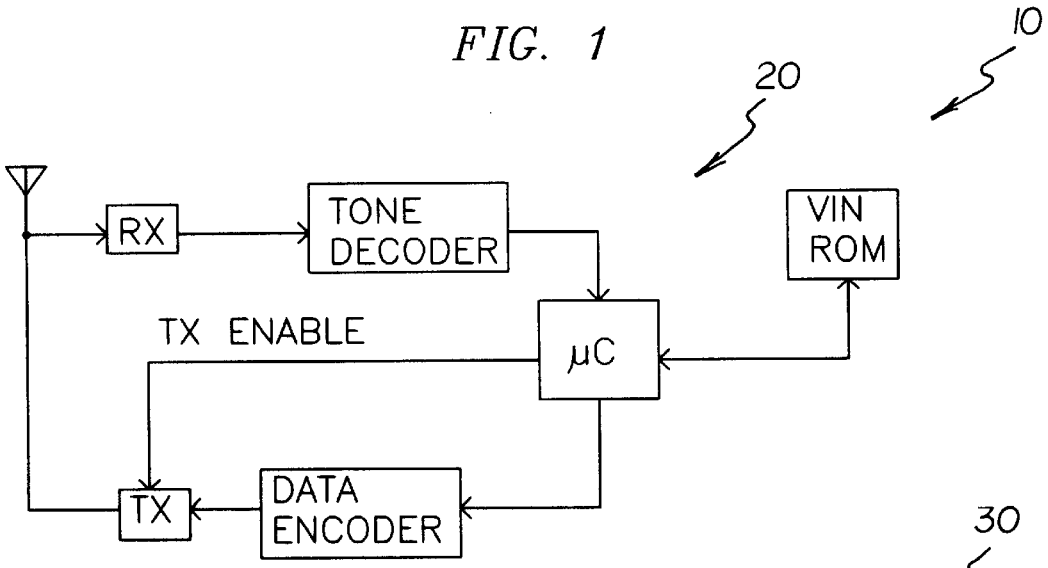
FIG. 1 is a schematic illustration of the vehicle unit comprised of conventional circuitry.
Figure 2:
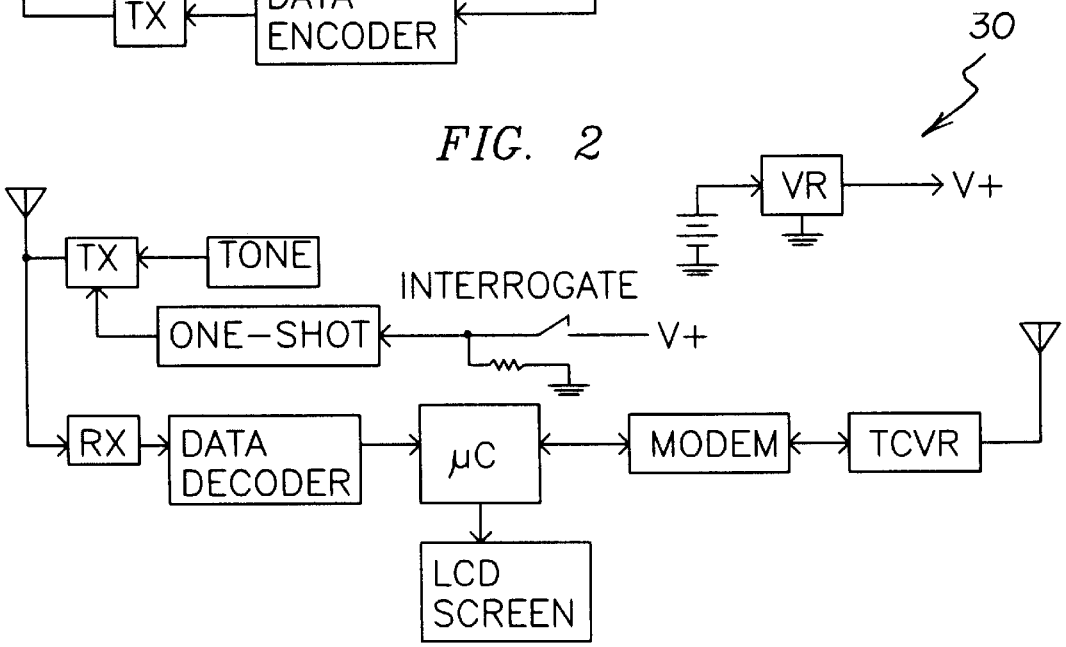
FIG. 2 is a schematic illustration of the portable unit comprised of conventional circuitry.
Figure 3:
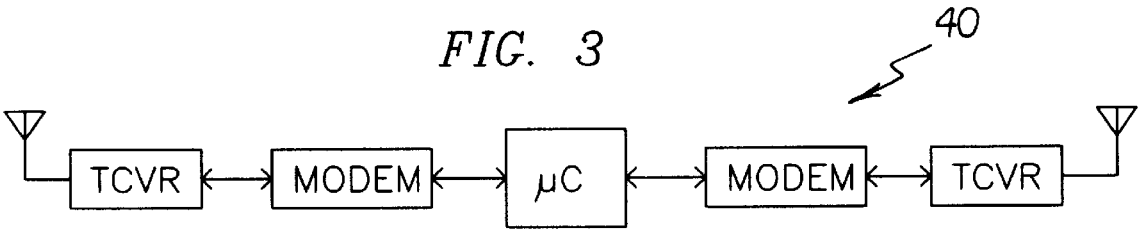
FIG. 3 is a schematic illustration of the digital repeater comprised of conventional circuitry.
Figure 4:
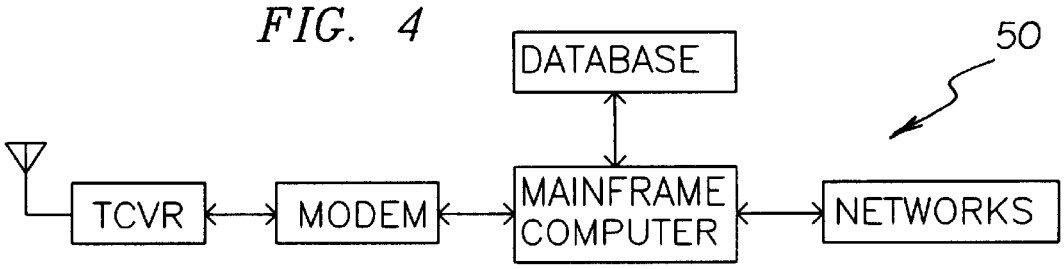
FIG. 4 is a schematic illustration of the receiver comprised of conventional circuitry.
Figure 5:
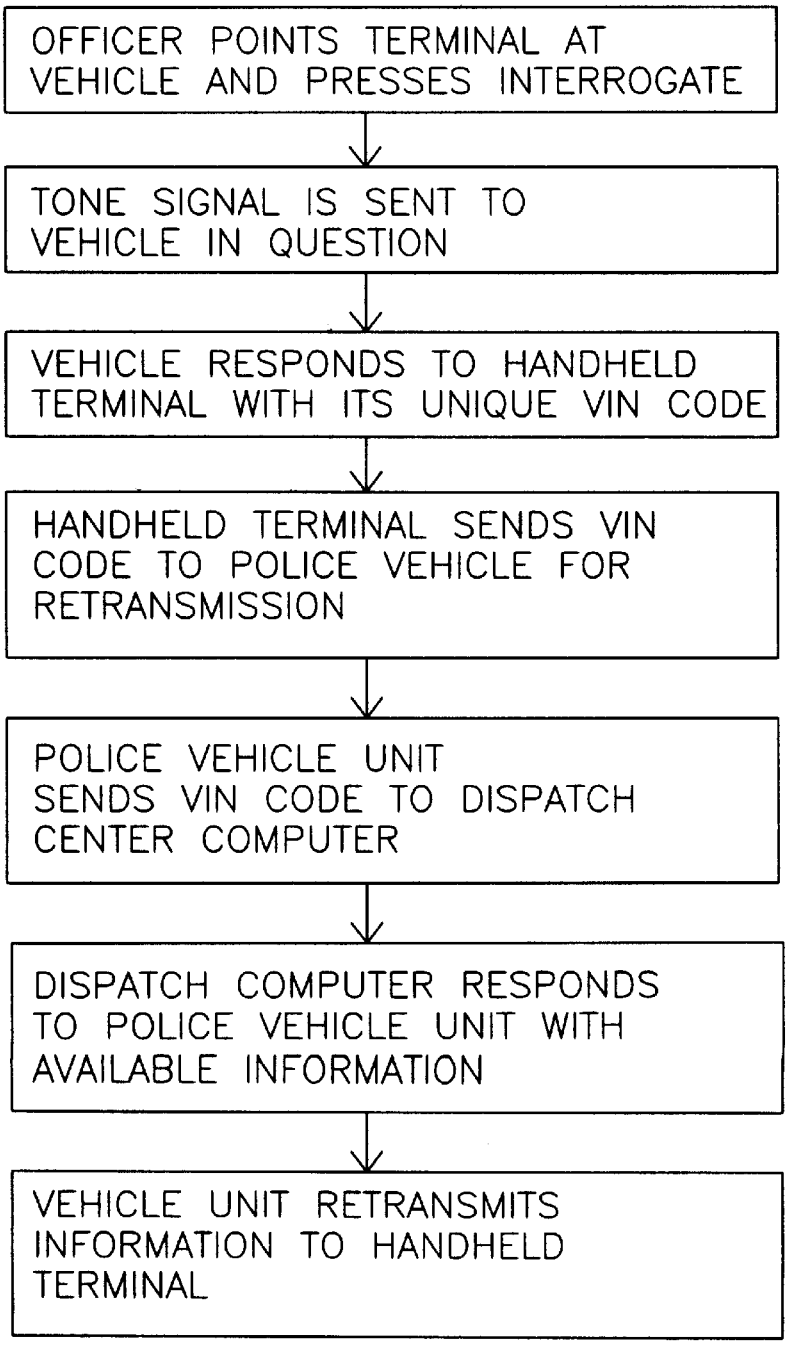
FIG. 5 PRIOR ART
FIG. 5 is a flow chart of the present invention well known in the art.

With reference now to the drawings, and in particular to FIGS. 1 through 5 thereof, a new VIN Reading and Transmitting System embodying the principles and concepts of the present invention and generally designated by the reference numeral 10 will be described.

More specifically, it will be noted that the VIN Reading and Transmitting System 10 comprises a vehicle unit 20 whereupon detecting an initiating signal transmits a coded signal containing a vehicle identification number (VIN) of a vehicle, a portable unit 30 which selectively transmits the initiating signal and detects the coded signal and relays the coded signal containing the vehicle identification number to a digital repeater 40, and the digital repeater 40 transmits the vehicle identification number to a receiver 50 positioned within a dispatch station which matches the vehicle identification number with information related to the vehicle and transmits the information to the portable unit 30 which displays the information.

The vehicle unit 20 is preferably formed within a license tab secured to a license plate of the vehicle. The information transmitted by the receiver 50 preferably comprises an owner of the vehicle, the vehicle's type, traffic offenses, warrants, insurance company, child support and whether the vehicle is stolen.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A vehicle identification number reading and transmitting system comprising:

a vehicle unit for transmitting a coded radio frequency signal upon reception of a radio frequency initiating signal by said vehicle unit, said coded signal containing a vehicle identification number of a vehicle;

a portable unit for selectively transmitting said initiating signal, said portable unit further being for receiving said coded signal transmitted by said vehicle unit, said portable unit having a digital repeater for re-transmitting said coded signal containing the vehicle identification number; and a receiver positioned within a dispatch station for receiving said re-transmitted coded signal from said digital repeater to permit use of said vehicle identification number to identify information related to said vehicle, said receiver further being for transmitting said information to said portable unit for displaying said information.

2. The vehicle identification number reading and transmitting system of claim 1, wherein said vehicle unit is formed within a license tab secured to a license plate of said vehicle for facilitating transmission of said initiating signal directly towards said vehicle unit.

3. The vehicle identification number reading and transmitting system of claim 2, wherein said information comprises an owner of said vehicle, said vehicle's type, and whether said vehicle is stolen.

* * * * *